US012422229B1

(12) United States Patent
Nance et al.

(10) Patent No.: US 12,422,229 B1
(45) Date of Patent: Sep. 23, 2025

(54) INITIATOR ASSEMBLY HAVING AN INITIATOR CARTRIDGE AND METHOD FOR CONSTRUCTING AN INITIATOR ASSEMBLY

(71) Applicant: Reynolds Systems, Inc., Middletown, CA (US)

(72) Inventors: Christopher J. Nance, Middletown, CA (US); Michael A. Amendola, Middletown, CA (US); John P. Segal, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 18/444,817

(22) Filed: Feb. 19, 2024

Related U.S. Application Data

(60) Provisional application No. 63/506,843, filed on Jun. 8, 2023.

(51) Int. Cl.
*F42B 3/12* (2006.01)

(52) U.S. Cl.
CPC ..... *F42B 3/125* (2013.01)

(58) Field of Classification Search
CPC ..... F42B 3/125
USPC ..... 102/202.7
See application file for complete search history.

(56) References Cited

U.S. PATENT DOCUMENTS

| | | | | |
|---|---|---|---|---|
| 5,969,286 | A * | 10/1999 | Ward | F42B 3/13 102/202.7 |
| 7,571,679 | B2 | 8/2009 | Nance | |
| 7,690,303 | B2 * | 4/2010 | Reynolds | F42B 3/121 102/202.7 |
| 8,100,043 | B1 | 1/2012 | Nance et al. | |
| 8,485,097 | B1 | 7/2013 | Nance et al. | |
| 8,726,808 | B1 | 5/2014 | Nance | |
| 10,267,605 | B1 | 4/2019 | Meadows | |
| 10,557,692 | B1 | 2/2020 | Amendola et al. | |
| 10,605,576 | B1 | 3/2020 | Nance et al. | |
| 10,794,670 | B1 | 10/2020 | Nance et al. | |
| 10,871,354 | B2 | 12/2020 | Amendola et al. | |
| 11,009,319 | B1 | 5/2021 | Morales et al. | |
| 11,448,487 | B1 * | 9/2022 | Morales | F42B 3/125 |
| 11,525,653 | B1 | 12/2022 | Nance et al. | |

* cited by examiner

*Primary Examiner* — Samir Abdosh
(74) *Attorney, Agent, or Firm* — Reising Ethington P.C.

(57) ABSTRACT

An initiator assembly having an initiator cartridge. The initiator cartridge has a cartridge housing, an initiation package and an input charge. The cartridge housing is formed of a plastic material and defines an outer circumferential surface, a recess, and a plurality of orientation features. The recess is formed into a first axial end of the cartridge housing. The orientation features are disposed through the first axial end of the cartridge housing and are disposed inwardly of the outer circumferential surface. The initiation package has an exploding foil initiator and a plurality of cartridge terminals. The exploding foil initiator has a bridge. The cartridge terminals are electrically coupled to the bridge. The initiation package is partly encapsulated in the plastic material that forms the cartridge housing. The input charge is at least partly formed of a secondary explosive and is received in the recess in the cartridge housing.

22 Claims, 6 Drawing Sheets

INITIATOR ASSEMBLY HAVING AN INITIATOR CARTRIDGE AND METHOD FOR CONSTRUCTING AN INITIATOR ASSEMBLY

CROSS-REFERENCE TO RELATED APPLICATIONS

This application claims the benefit of U.S. Provisional Patent Application No. 63/506,843 filed Jun. 8, 2023, the disclosure of which is incorporated by reference as if fully set forth in detail herein.

FIELD

The present disclosure generally relates to an initiator assembly having an initiator cartridge and to a related method for constructing an initiator assembly.

BACKGROUND

This section provides background information related to the present disclosure which is not necessarily prior art.

Initiator assemblies having an exploding foil initiator (EFI) can be configured in various different forms, such as a detonator that outputs a shockwave that is intended to initiate the detonation of a charge of energetic material, and an igniter that outputs energy that is intended to initiate the combustion or deflagration of a charge of energetic material. Specifications for such initiator assemblies frequently require that the initiator assembly have a metal (i.e., steel or aluminum) housing in which various components of the initiator assembly, including the exploding foil initiator, an input charge and an output charge, are hermetically sealed.

Heretofore, the electrical contacts of the exploding foil initiator have been soldered to intermediate conductors that are in turn electrically coupled to the to external terminals (i.e., initiator terminals) that exend through the housing of the initiator assembly.

While this soldering technique has been satisfactory for the purpose of electrically coupling the intermediate conductors to the initiator terminals, we have noted several drawbacks. In particular, there is a need to wash, dry and inspect components after the soldering operation. These additional steps, particularly the inspection step, are costly and tend to limit throughput. Consequently, there is a need in the art for an initiator assembly that utilizes an exploding foil initiator that is electrically coupled via intermediate conductors to the external initiator terminals of the initiator assembly without the use of solder.

SUMMARY

This section provides a general summary of the disclosure, and is not a comprehensive disclosure of its full scope or all of its features.

In one form, the present disclosure provides an initiator assembly having an initiator cartridge. The initiator cartridge has a cartridge housing, an initiation package and an input charge. The cartridge housing is formed of a plastic material and defines an outer circumferential surface, a recess, and a plurality of orientation features. The recess is formed into a first axial end of the cartridge housing. The orientation features are disposed through the first axial end of the cartridge housing and are disposed inwardly of the outer circumferential surface. The initiation package has an exploding foil initiator and a plurality of cartridge terminals.

The exploding foil initiator has a bridge. The cartridge terminals are electrically coupled to the bridge. The initiation package is partly encapsulated in the plastic material that forms the cartridge housing. The input charge is at least partly formed of a secondary explosive and is received in the recess in the cartridge housing.

In some forms, a void space is formed in the first axial end of the cartridge housing. The void space is disposed outwardly of the recess and inwardly of the outer circumferential surface. Optionally, the void space forms an annular channel.

In some forms, the initiator assembly also includes an initiator housing that has a housing structure and a plurality of initiator terminals. The housing structure has a housing member, which defines a cavity, and a wall member that bounds a first side of the cavity. A plurality of terminal apertures are formed in the wall member. Each of the initiator terminals extends through an associated one of the terminal apertures and is electrically coupled to an associated one of the cartridge terminals. The initiator cartridge is received in the cavity.

In some forms, the initiator assembly can include an output charge that is received in the cavity such that the initiator cartridge is disposed between the wall member and the output charge.

In some forms, the intitiator assembly can further include a closure member that is coupled to the initiator housing to close the cavity in the housing structure.

In some forms, the initiator housing can include a plurality of seal members. Each of the seal members is received in an associated one of the terminal apertures and is sealingly engaged to the wall member and a corresponding one of the initiator terminals. The seal members can be formed of glass or an epoxy material, for example.

Optionally, a void space is formed in the first axial end of the cartridge housing. The void space is disposed outwardly of the recess and inwardly of the outer circumferential surface.

In some forms, the initiation package further includes a plurality of intermediate contacts. Each of the intermediate contacts is directly coupled to an associated electrical contact of the exploding foil initiator and to an associated one of the cartridge terminals.

Optionally, each of the cartridge terminals includes a conductive sleeve and a locking member. Each of the initiator terminals includes a first pin portion that is received into the conductive sleeve and is engaged by the locking member of corresponding one of the cartridge terminals. The locking members can electrically and mechanically engage the initiator terminals. Optionally, each of the locking members is integrally and unitarily formed with a corresponding one of the conductive sleeves.

In some forms, the initiator cartridge further includes an insertion guide coupled to the cartridge housing, the insertion guide is configured to guide the initiator cartridge onto the initiator housing. Optionally, the insertion guide can include a frusto-conical surface on the cartridge housing and can be configured to guide a corresponding one of the cartridge terminals into engagement with a corresponding one of the initiator terminals.

In some forms, each of the orientation features includes a semi-cylindrical recess.

In some forms, the housing member and the wall member are integrally and unitarily formed.

In some forms, the wall member of the initiator housing is a discrete component that is received into the housing member, the wall member is fixedly coupled to the housing member.

In some forms, the orientation features are identically shaped.

In some forms, the exploding foil initiator includes a bridge, a flyer layer, and a barrel. The flyer layer overlies the bridge. The barrel overlies the flyer layer and defines a barrel aperture. The barrel is unitarily and integrally formed with the cartridge housing.

In another form, the present disclosure provides a method for constructing an initiator assembly. The method includes: providing an initiator cartridge having a cartridge housing, an initiation package and an input charge, the cartridge housing being formed of a plastic material and defining an outer circumferential surface, a recess, and a plurality of orientation features, the recess being formed into a first axial end of the cartridge housing, the initiation package having an exploding foil initiator and a plurality of cartridge terminals, the exploding foil initiator having a bridge, the cartridge terminals being electrically coupled to the bridge, the initiation package being at least partly encapsulated in the plastic material that forms the cartridge housing, the input charge being at least partly formed of a secondary explosive and being received in the recess in the cartridge housing; providing an initiator housing having a housing structure and a plurality of initiator terminals, the housing structure having a housing member, which defines a cavity, and a wall member, the wall member bounding a first side of the cavity, wherein a plurality of terminal apertures are formed in the wall member, each of the initiator terminals extending through an associated one of the terminal apertures; sliding the initiator cartridge into the cavity along an insertion axis to mechanically and electrically engage the cartridge terminals to the initiator terminals; and sliding an output charge into the cavity along the insertion axis. The initiator cartridge is disposed in the cavity along the insertion axis between the wall member and the output charge.

In some forms, the housing member and the wall member are integrally and unitarily formed. Optionally, the method further includes coupling a cover to the housing structure to close a second side of the cavity that is opposite the first side.

In some forms, the wall member is a discrete component that is received into the housing member along the insertion axis and the method further includes fixedly coupling the wall member to the housing member.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
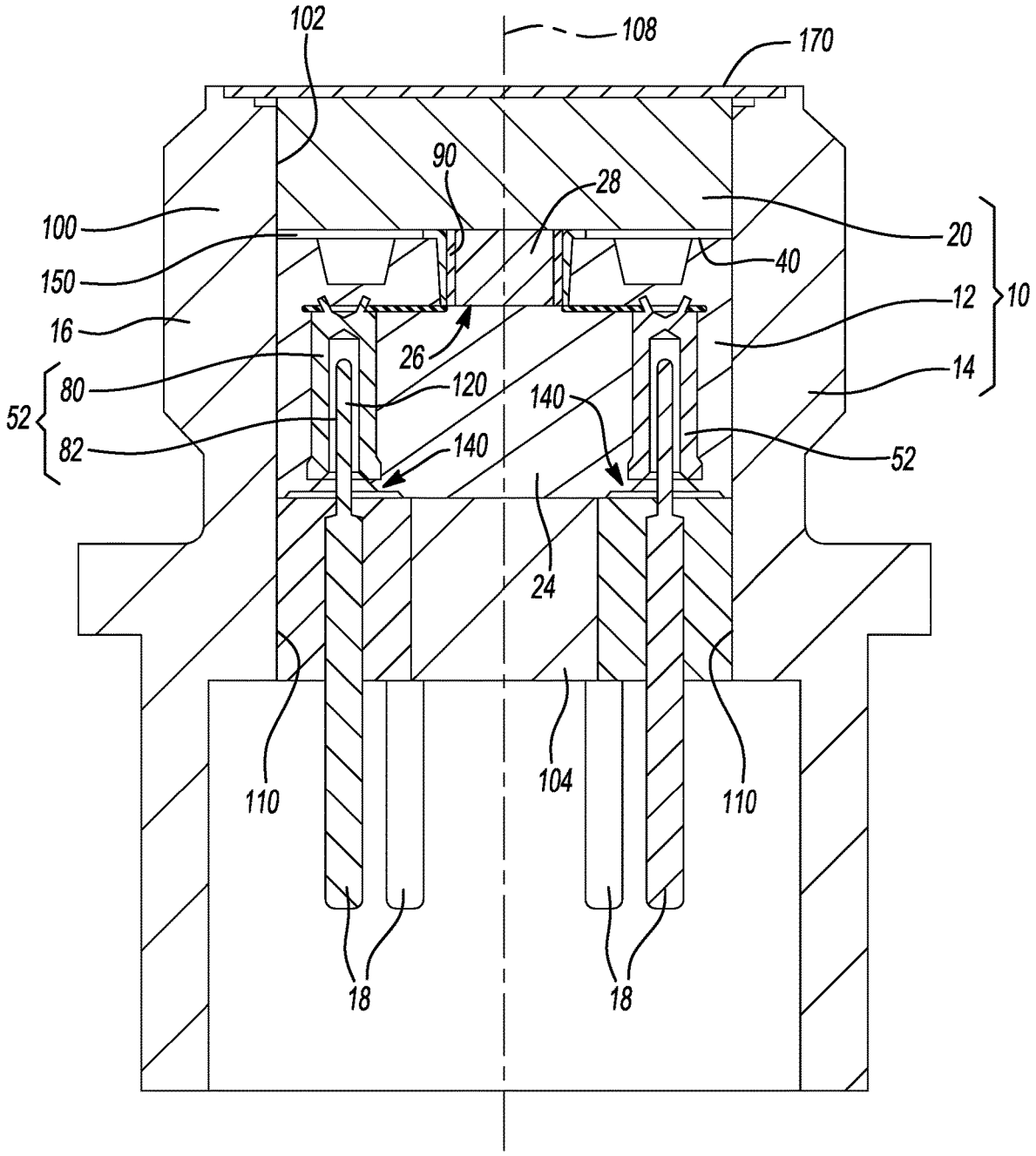
FIG. 1 is a longitudinal section view of an exemplary initiator assembly constructed in accordance with the teachings of the present disclosure.
Figure 2:
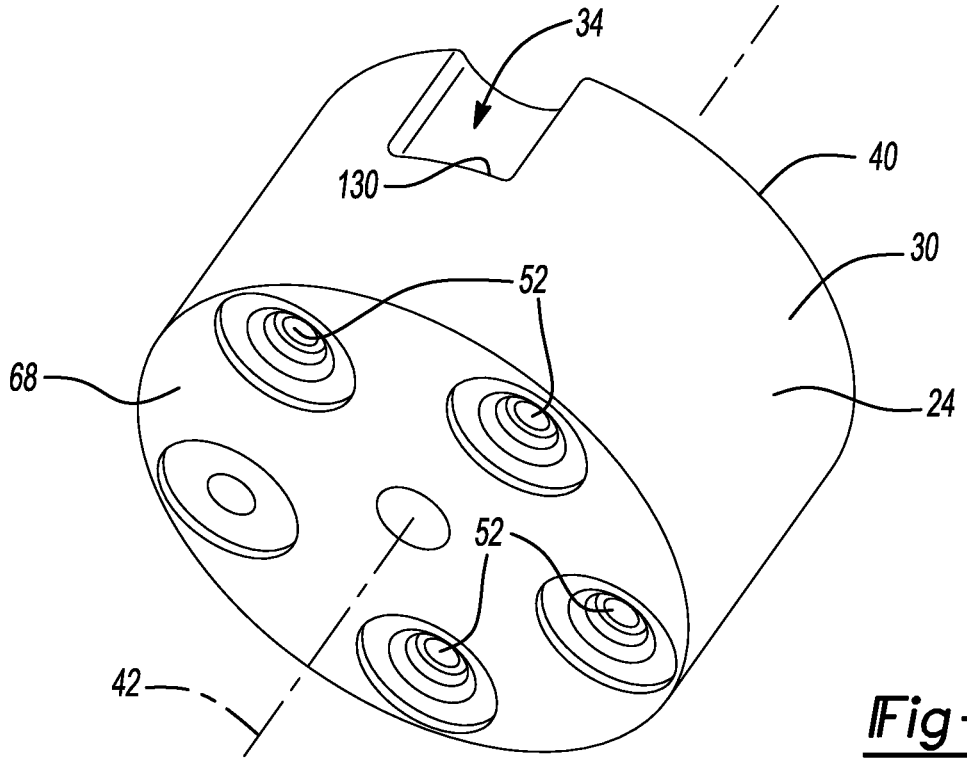
FIGS. 2 and 3 are bottom and top perspective views, respectively, of a portion of the initiator assembly of FIG. 1 illustrating a cartridge housing in more detail.

With reference to FIG. 1, an exemplary initiator assembly constructed in accordance with the teachings of the present disclosure is generally indicated by reference numeral 10. The initiator assembly 10 includes an initiator cartridge 12 and optionally an initiator housing 14, which has a housing structure 16 and a plurality of initiator terminals 18, and an output charge 20. The initiator cartridge 12 has a cartridge housing 24, an initiation package 26 and an input charge 28.

With reference to FIGS. 2 through 5, the cartridge housing 24 is formed of an electrically-insulating plastic material and defines an outer circumferential surface 30, a recess 32, and a plurality of orientation features 34. The recess 32 is formed into a first axial end 40 of the cartridge housing 24 along an axis 42. Each of the orientation features 34 is disposed through the first axial end 40 of the cartridge housing 24 and is disposed inwardly of the outer circumferential surface 30. If desired, the orientation features 34 can be sized and/or shaped in an identical manner. In the example provided, each of the orientation features 34 is an identically sized recess having a semi-cylindrical shape. The orientation features 34 are located on the initiator cartridge 12 in a predetermined manner that is associated with a datum of the initiator cartridge 12. Optionally, a void space 48 can be formed in the first axial end 40 of the cartridge housing 24. The void space 48 can be disposed outwardly of the recess 32 and inwardly of the outer circumferential surface 30. In the example provided, the void space 48 forms an annular channel.

Figure 6:
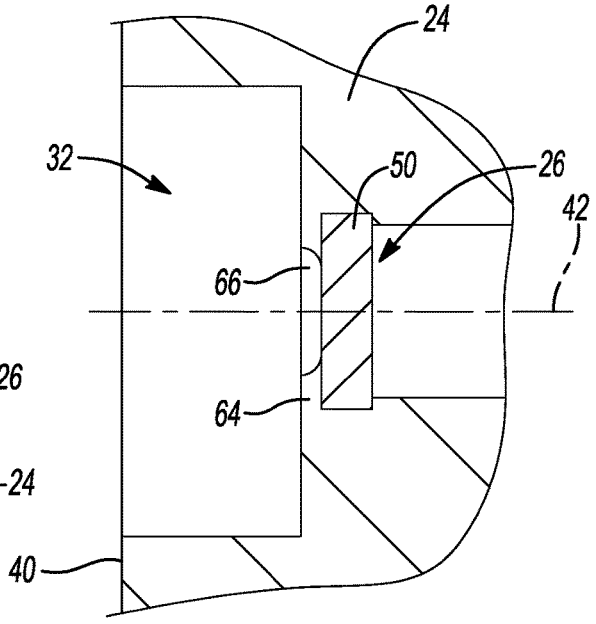
FIG. 6 is an enlarged view of an encircled portion of FIG. 5.
Figure 7:
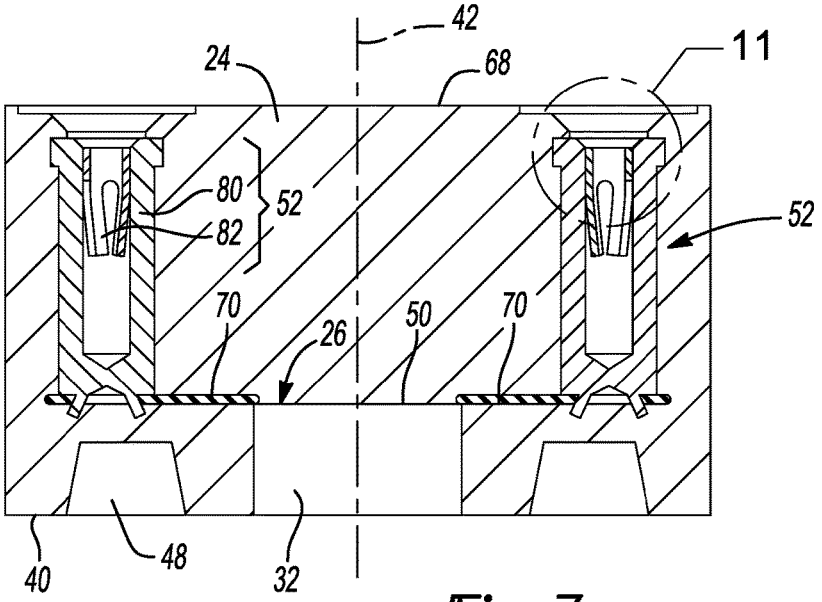
FIG. 7 is a longitudinal section view of the cartridge housing taken longitudinally through a pair of conductive sleeves.
Figure 8:
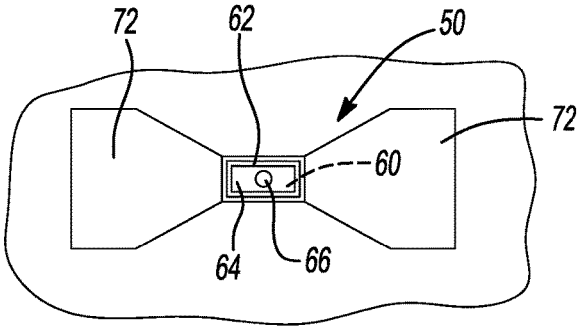
FIG. 8 is a top plan view of a portion of the cartridge housing illustrating a exploding foil initiator in more detail.

With reference to FIGS. 2, 4, 6 and 7, the initiation package 26 is partly encapsulated into the cartridge housing 24 and has an exploding foil initiator 50 and a plurality of cartridge terminals 52. The exploding foil initiator 50 has a bridge 60 (FIG. 8), a flyer layer 62 (FIG. 8), which overlies the bridge 60 (FIG. 8), and a barrel 64 (FIG. 8) that is disposed over the flyer layer 62 (FIG. 8). The barrel 64 (FIG. 8) defines a barrel aperture 66 (FIG. 8). Optionally, the barrel 64 can be unitarily and integrally formed with the cartridge housing 24 as shown in FIG. 6. The cartridge terminals 52 are electrically coupled to the bridge 60 (FIG. 8). Each of the cartridge terminals 52 extends through the cartridge housing 24. In the example provided, each of the cartridge terminals 52 is recessed below a second axial end 68 of the cartridge housing 24 that is opposite the first axial end 40. In some forms, the initiation package 26 further includes a plurality of intermediate contacts 70 that electrically couple a respective one of the cartridge terminals 52 to an associated bridge contact 72 (FIG. 8) on the exploding foil initiator 50. For example, the intermediate contacts 70 can be soldered to the bridge contacts 72 (FIG. 8) and can be soldered and/or swaged to the cartridge terminals 52.

Figure 9:
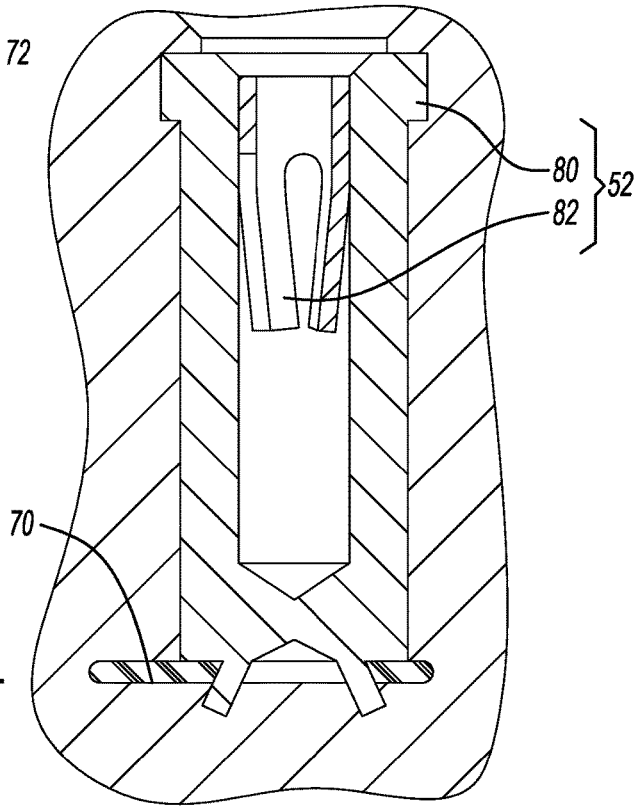
FIG. 9 is an enlarged portion of FIG. 7 illustrating one of the conductive sleeves in more detail.

With reference to FIG. 9, each of the cartridge terminals 52 in the particular example shown includes a conductive sleeve 80 and a locking member 82. Each of the locking members 82 can be formed as a discrete component that is assembled into a corresponding one of the conductive sleeves 80, or can be integrally and unitarily formed with the corresponding one of the conductive sleeves 80. Each of the locking members 82 is configured to engage the initiator housing 14 (FIG. 1) in a "snap-fit" manner as will be explained in more detail below.

Figure 3:
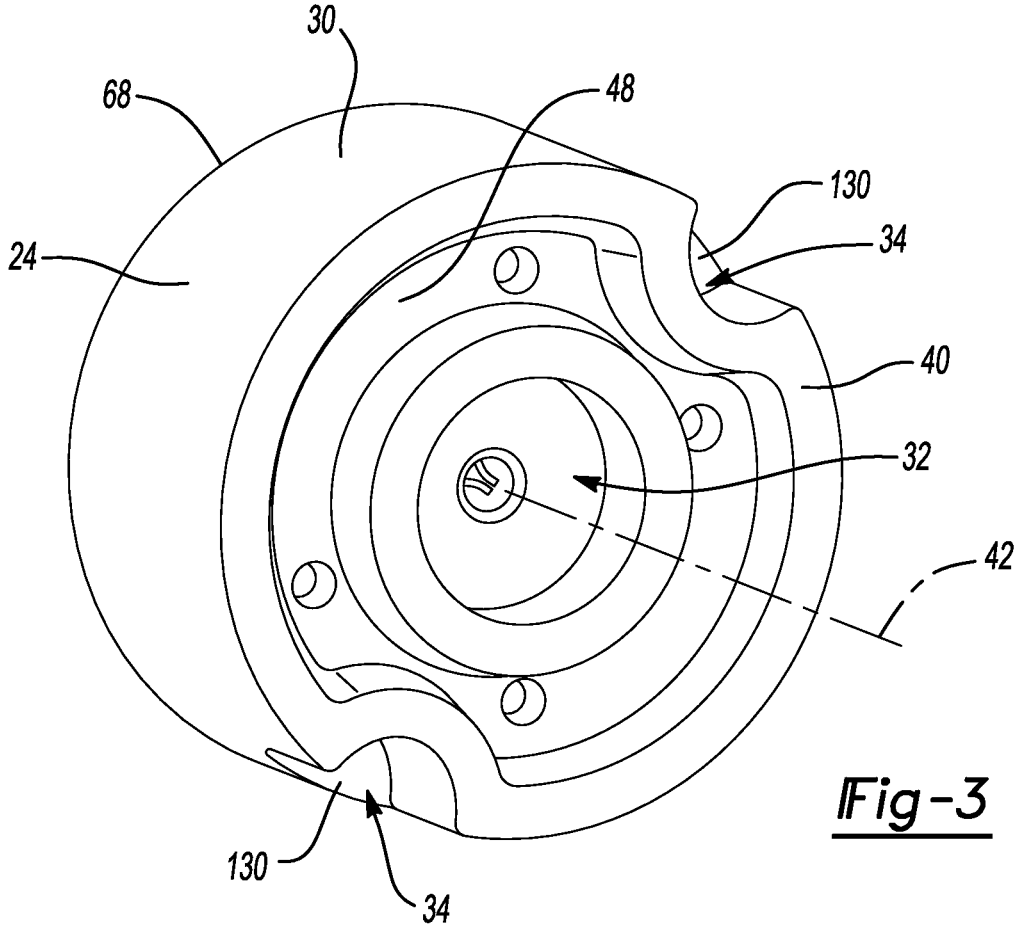
Figure 5:
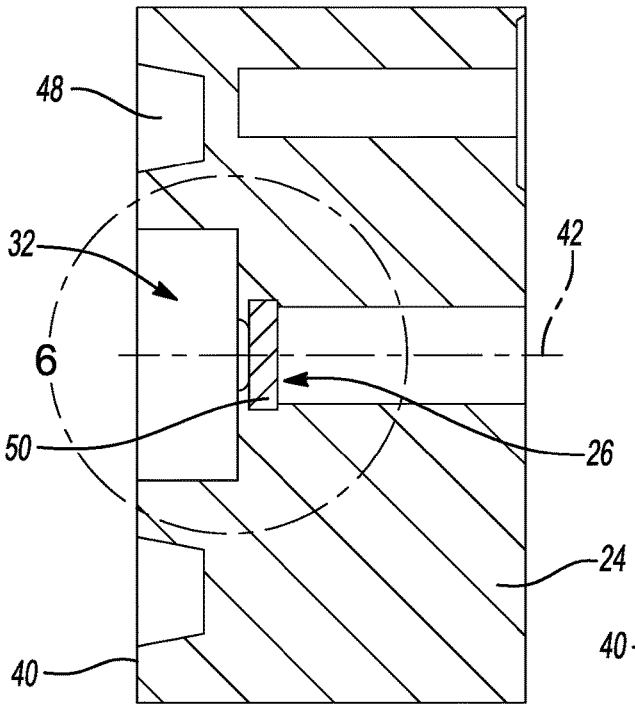
FIG. 5 is a section view taken along the line 5-5 of FIG. 4.

With reference to FIGS. 1, 3 and 5, the input charge 28 is at least partly formed of a secondary explosive and is received in the recess 32 in the cartridge housing 24. In some forms, the material that forms the input charge 28 is consolidated (i.e., compacted at a predetermined pressure) into a pellet-like structure that is thereafter inserted into the recess 32. Alternatively, the material that forms the input charge 28 can be consolidated directly in the recess 32 in the cartridge housing 24. Optionally, a support ring 90 can be disposed about the input charge 28. In some forms, the input charge 28 is consolidated within the support ring 90 and the assembly (i.e., the support ring 90 together with the input charge 28) is inserted into the recess 32.

Figure 10:
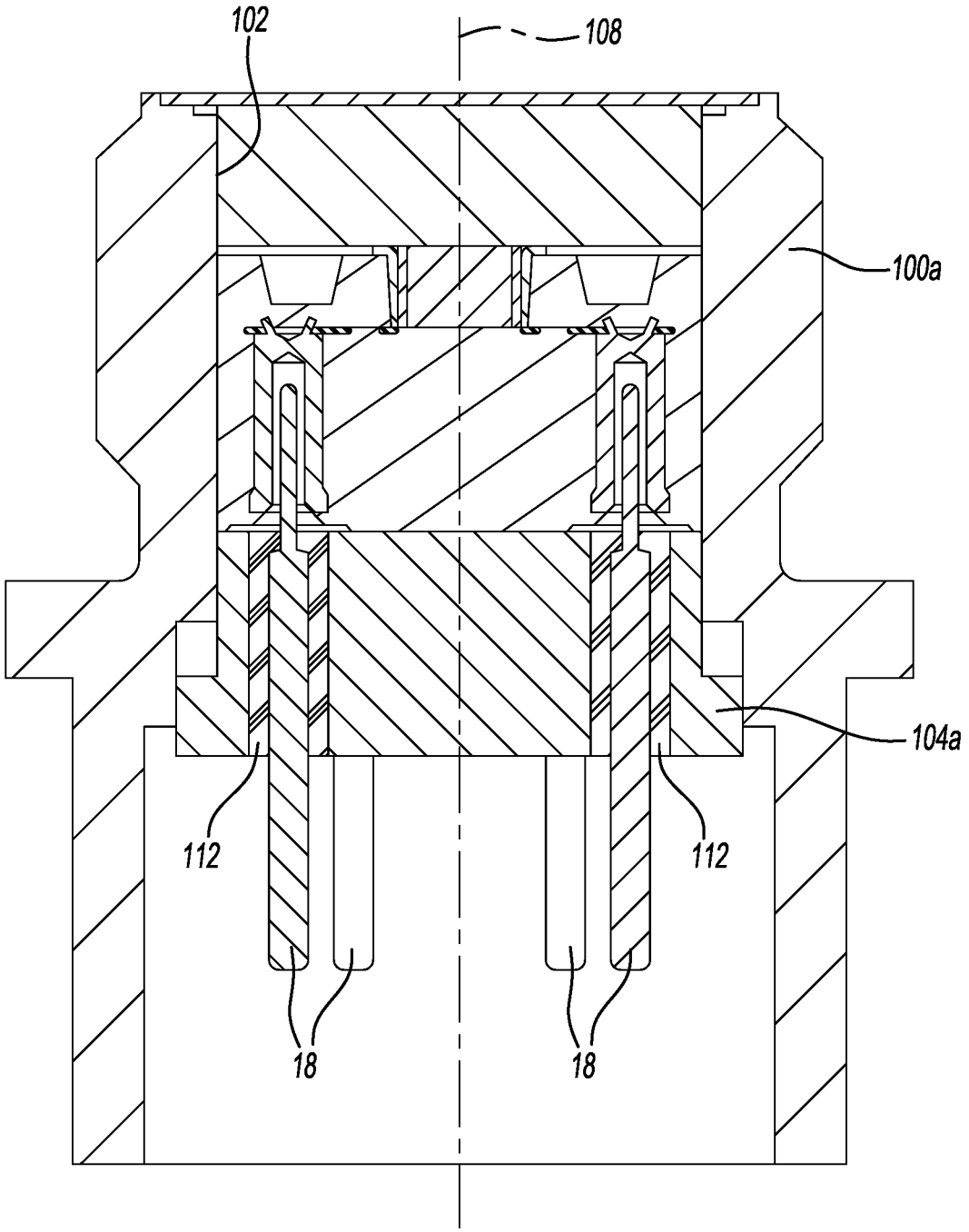
FIG. 10 is a longitudinal section view of a second initiator assembly constructed in accordance with the teachings of the present disclosure.

With reference to FIG. 1, the housing structure 16 of the initiator housing 14 can have a housing member 100, which defines a cavity 102, and a wall member 104 that bounds a first side of the cavity 102. In the example shown, the housing member 100 and the wall member 104 are integrally and unitarily formed, and the cavity 102 extends through an axial end of the housing member 100. It will be appreciated, however, that the housing structure 16 could be formed somewhat differently. For example, the wall member 104 can be formed as a discrete component that can be assembled to the housing member 100*a* as shown in FIG. 10. In this example, the cavity 102 is formed as a through hole that is bored through the housing member 100*a*, and the wall member 104*a* can be received into the housing member 100*a* (e.g., slid into the a portion of the housing member 100*a*, such as the cavity 102, along an insertion axis 108) and can be fixedly coupled to the housing member 100 in a desired manner, such as laser welding.

Returning to FIG. 1, a plurality of terminal apertures 110 are formed in the wall member 104. Each of the initiator terminals 18 extends through an associated one of the terminal apertures 110. The initiator housing 14 can include a plurality of seal members 112, each of which being received in an associated one of the terminal apertures 110 and being sealingly engaged to the wall member 104 and a corresponding one of the initiator terminals 18. The seal members 112 can be formed of any suitable material, such as glass or a cured epoxy material.

The initiator cartridge 12 is received into the cavity 102 and each of the initiator terminals 18 is electrically coupled to a corresponding one of the cartridge terminals 52. In the example provided, each of the initiator terminals 18 includes a first pin portion 120 that extends into the cavity 102 and is received into the conductive sleeve 80 of the corresponding cartridge terminal 52 when the initiator cartridge 12 is inserted into the cavity 102 along an insertion axis 108. If included, the locking members 82 of the cartridge terminals 52 can mechanically and electrically engage the first pin portion 120 of the initiator terminals 18. In the example provided, the locking members 82 are blade-like elements that resiliently engage the first pin portions 120 of the initiator terminals 18.

With reference to FIGS. 1 and 3, the orientation features 34 on the cartridge housing 24 are employed to orient the initiator cartridge 12 relative to the initiator housing 14 to thereby ensure that the cartridge terminals 52 are oriented to engage the initiator terminals 18 in a desired manner. In the example provided, the orientation features 34 are located and shaped to permit the initiator cartridge 12 to be "picked" by an end effector (not shown) of a pick-and-place robot (not shown) so that the datum of the initiator cartridge 12 is disposed in a known position relative to the end effector. The initiator housing 14 can be disposed in a predetermined orientation and the pick-and-place robot can insert the initiator cartridge 12 into the cavity 102 and press the initiator cartridge 12 into the housing member 100 toward the wall member 104 to engage the cartridge terminals 52 to the initiator terminals 18. In this regard, the end effector is able to press on the flat semi-circular shoulders 130 that are formed by the orientation features 34 to exert sufficient force onto the initiator cartridge 12 to cause the cartridge terminals 52 to matingly engage with the initiator terminals 18.

Figure 4:
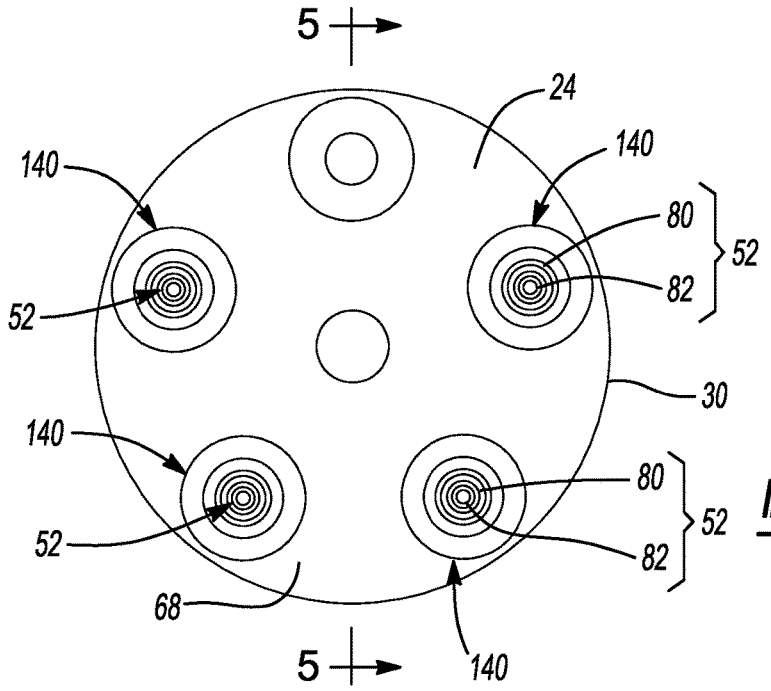
FIG. 4 is a bottom view of the cartridge housing.
Figure 11:
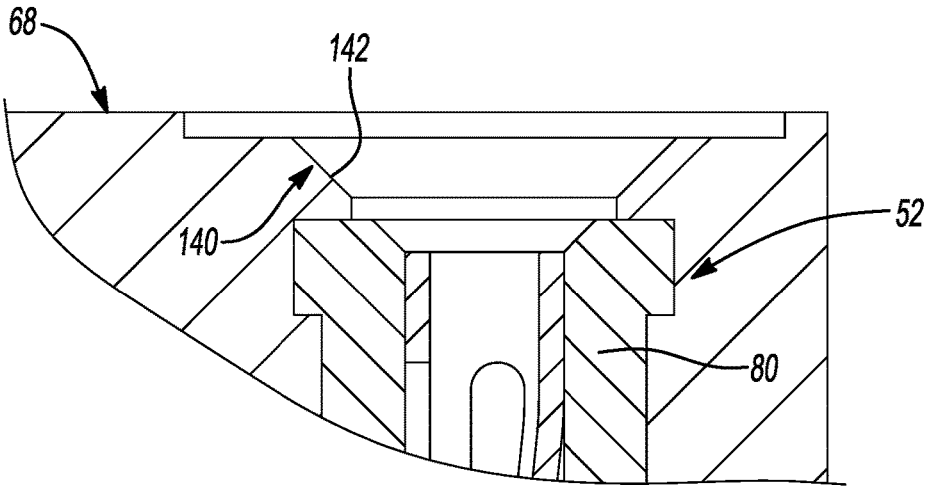
FIG. 11 is an enlarged view of an encircled portion of FIG. 7.

With reference to FIGS. 1, 4 and 11, the initiator cartridge 12 can optionally include one or more insertion guides 140 that can be coupled to the cartridge housing 24 and configured to guide the initiator cartridge 12 onto the initiator housing 14. In the example provided, a plurality of insertion guides 140 are employed, with each insertion guide 140 having a frusto-conical surface 142 that is formed on the cartridge housing 24 and being configured to guide a corresponding one of the initiator terminals 18 into engagement with a corresponding one of the cartridge terminals 52. In this regard, the contact between the frusto-conical surfaces 142 of the insertion guides 140 and the first pin portions 120 of the initiator terminals 18 can cause the first pin portions 120 to deflect such that they are centered within the conductive sleeves 80.

Figure 12:
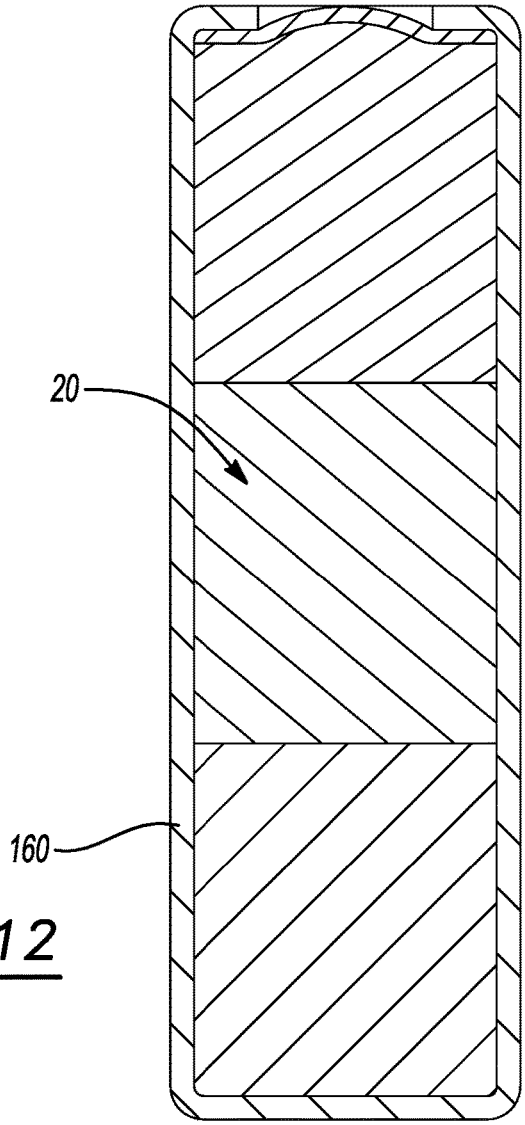
FIG. 12 is a longitudinal section view depicting an output charge for the initiator assembly of FIG. 1 or 10 as being disposed in a sealed container.

In FIG. 1, the output charge 20 is received in the cavity 102 and is disposed adjacent to the initiator cartridge 12. In the example shown, the output charge 20 is spaced apart from the first axial end 40 of the initiator housing 24 by an optional spacing element 150. The spacing element 150 could be formed of one or more components and can be configured to form a seal or barrier between the output charge 20 and the initiator cartridge 12, and/or to elastically deform to create a small axially-directed preload that is applied to the output charge 20 and/or to take up a variable volume in the cavity 102 (created due to variances in the volume of one or more of the output charge 20 and the initiator cartridge 12. The output charge 20 can be formed of an appropriate energetic material, such as a secondary explosive material or a pyrotechnic material. If formed of a secondary explosive, the output charge 20 is configured to detonate in response to receipt of a shock wave produced by detonation of the input charge 28, which is initiated by a shock wave created by operation of the exploding foil initiator 50. If formed of a pyrotechnic material (i.e., a non-detonating material that is able to undergo a self-sustain exothermic chemical reaction), the output charge 20 is configured to combust or deflagrate in response to energy received from the detonation of the input charge 28 and one or more layers of material can be disposed between the input charge 28 and the output charge 20 to convert energy released by detonation of the input charge 28 into heat that can be input to the output charge 20 to initiate combustion and/or deflagration. If desired, the output charge 20 can be segregated from the input charge 28 via one or more barrier layers (not shown) or can be contained within a container 160 (FIG. 12). The barrier layer(s) can be employed to segregate the portion of the cavity 102 in which the output charge 20 is disposed from the remainder of the cavity 102, and/or to attenuate the shock wave produced by detonation of the input charge 28 and/or to aid in converting the energy released from the detonation of the input charge 28 into heat. The container 160 (FIG. 12) could be a closed container, in which the output charge 20 is disposed entirely within the container 160 (FIG. 12), or could be a cup-like container with a closed bottom that is disposed proximate the input charge 28.

Optionally, the initiator housing 14 can further include a cover member 170 that can be fixedly coupled to the housing member 100 to close the cavity 102. The cover member 170 can be formed of an appropriate material, such as a steel or aluminum material that is compatible with the material that forms the housing member 100, and can be welded (e.g., laser welded) to an axial end of the housing member 100.

The initiator assembly 10 can be constructed such that the components within the cavity 102, in particular the exploding foil initiator 50, the input charge 28 and the output charge 20, are hermetically sealed (i.e., sealed to such an extent that weld and seal interfaces leak at a rate less than about $1\times10^{-5}$ or $1\times10^{-6}$ scc/s when one side of the interface is exposed to helium gas at a gauge pressure of about 1 atmosphere while the other side of the interface is exposed to atmospheric pressure.

A method for constructing the initiator assembly 10 is further provided. The method includes: providing an initiator cartridge having a cartridge housing, an initiation package and an input charge, the cartridge housing being formed of a plastic material and defining an outer circumferential surface, a recess, and a plurality of orientation features, the recess being formed into a first axial end of the cartridge housing, the initiation package having an exploding foil initiator and a plurality of cartridge terminals, the exploding foil initiator having a bridge, the cartridge terminals being electrically coupled to the bridge, the initiation package being at least partly encapsulated in the plastic material that forms the cartridge housing, the input charge being at least partly formed of a secondary explosive and being received in the recess in the cartridge housing; providing an initiator housing having a housing structure and a plurality of initiator terminals, the housing structure having a housing member, which defines a cavity, and a wall member, the wall member bounding a first side of the cavity, wherein a plurality of terminal apertures are formed in the wall member, each of the initiator terminals extending through an associated one of the terminal apertures; sliding the initiator cartridge into the cavity along an insertion axis to mechanically and electrically engage the cartridge terminals to the initiator terminals; and sliding an output charge into the cavity along the insertion axis; wherein the initiator cartridge is disposed in the cavity along the insertion axis between the wall member and the output charge.

Optionally, the housing member and the wall member are integrally and unitarily formed and the method further comprises coupling a cover to the housing structure to close a second side of the cavity that is opposite the first side.

Also optionally, the wall member is a discrete component that is received into the housing member along the insertion axis, and the method further comprises fixedly coupling the wall member to the housing member.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

an initiator cartridge having a cartridge housing, an initiation package and an input charge, the cartridge housing being formed of a plastic material and defining an outer circumferential surface, a recess, and a plurality of orientation features, the recess being formed into a first axial end of the cartridge housing, the orientation features being disposed through the first axial end of the cartridge housing and being disposed inwardly of the outer circumferential surface, the initiation package having an exploding foil initiator and a plurality of cartridge terminals, the exploding foil initiator having a bridge, the cartridge terminals being electrically coupled to the bridge, the initiation package being at least partly encapsulated in the plastic material that forms the cartridge housing, the input charge being at least partly formed of a secondary explosive and being received in the recess in the cartridge housing, wherein a void space is formed in the first axial end of the cartridge housing, the void space being disposed outwardly of the recess and inwardly of the outer circumferential surface.

2. The initiator assembly of claim 1, wherein the void space forms an annular channel.

3. An initiator assembly comprising:

an initiator cartridge having a cartridge housing, an initiation package and an input charge, the cartridge housing being formed of a plastic material and defining an outer circumferential surface, a recess, and a plurality of orientation features, the recess being formed into a first axial end of the cartridge housing, the orientation features being disposed through the first axial end of the cartridge housing and being disposed inwardly of the outer circumferential surface, the initiation package having an exploding foil initiator and a plurality of cartridge terminals, the exploding foil initiator having a bridge, the cartridge terminals being electrically coupled to the bridge, the initiation package being at least partly encapsulated in the plastic material that forms the cartridge housing, the input charge being at least partly formed of a secondary explosive and being received in the recess in the cartridge housing;

an initiator housing having a housing structure and a plurality of initiator terminals, the housing structure having a housing member, which defines a cavity, and a wall member that bounds a first side of the cavity, wherein a plurality of terminal apertures are formed in the wall member, each of the initiator terminals extending through an associated one of the terminal apertures and being electrically coupled to an associated one of the cartridge terminals, the initiator cartridge being received in the cavity;

an output charge received in the cavity and disposed adjacent to the initiator cartridge; and a closure member coupled to the initiator housing to close the cavity in the housing structure.

4. The initiator assembly of claim 3, wherein the seal members are formed of glass.

5. The initiator assembly of claim 3, wherein the seal members are formed of a cured epoxy material.

6. The initiator assembly of claim 3, wherein a void space is formed in the first axial end of the cartridge housing, the void space being disposed outwardly of the recess and inwardly of the outer circumferential surface.

7. The initiator assembly of claim 3, wherein the initiation package further comprises a plurality of intermediate contacts, each of the intermediate contacts being directly coupled to an associated electrical contact of the exploding foil initiator and to an associated one of the cartridge terminals.

8. The initiator assembly of claim 3, wherein each of the cartridge terminals comprises a conductive sleeve and a locking member, wherein each of the initiator terminals includes a first pin portion that is received into the conductive sleeve and engaged by the locking member of corresponding one of the cartridge terminals.

9. The initiator assembly of claim 3, wherein the locking members electrically and mechanically engage the initiator terminals.

10. The initiator assembly of claim 3, wherein each of the locking members is integrally and unitarily formed with a corresponding one of the conductive sleeves.

11. The initiator assembly of claim 3, wherein further comprising an insertion guide coupled to the cartridge housing, the insertion guide being configured to guide the initiator cartridge onto the initiator housing.

12. The initiator assembly of claim 3, wherein the insertion guide comprises a frusto-conical surface on the cartridge housing and is configured to guide a corresponding one of the cartridge terminals into engagement with a corresponding one of the initiator terminals.

13. The initiator assembly of claim 3, wherein the housing member and the wall member are integrally and unitarily formed.

14. The initiator assembly of claim 3, wherein the wall member is a discrete component that is received into the housing member, the wall member being is fixedly coupled to the housing member.

15. The initiator assembly of claim 1, wherein each of the orientation features is identically shaped.

16. The initiator assembly of claim 1, wherein the exploding foil initiator comprises a bridge, a flyer layer, and a barrel, wherein the flyer layer overlies the bridge, wherein the barrel overlies the flyer layer and defines a barrel aperture, and wherein the barrel is unitarily and integrally formed with the cartridge housing.

17. The initiator assembly of claim 1, wherein each of the orientation features comprises a semi-cylindrical recess.

18. A method for constructing an initiator assembly, the method comprising:

providing an initiator cartridge having a cartridge housing, an initiation package and an input charge, the cartridge housing being formed of a plastic material and defining an outer circumferential surface, a recess, and a plurality of orientation features, the recess being formed into a first axial end of the cartridge housing, the initiation package having an exploding foil initiator and a plurality of cartridge terminals, the exploding foil initiator having a bridge, the cartridge terminals being electrically coupled to the bridge, the initiation package being at least partly encapsulated in the plastic material that forms the cartridge housing, the input charge being at least partly formed of a secondary explosive and being received in the recess in the cartridge housing;

providing an initiator housing having a housing structure and a plurality of initiator terminals, the housing structure having a housing member, which defines a cavity, and a wall member, the wall member bounding a first side of the cavity, wherein a plurality of terminal apertures are formed in the wall member, each of the initiator terminals extending through an associated one of the terminal apertures;

sliding the initiator cartridge into the cavity along an insertion axis to mechanically and electrically engage the cartridge terminals to the initiator terminals; and sliding an output charge into the cavity along the insertion axis;

wherein the initiator cartridge is disposed in the cavity along the insertion axis between the wall member and the output charge.

19. The method of claim 18, wherein the housing member and the wall member are integrally and unitarily formed.

20. The method of claim 19, further comprising coupling a cover to the housing structure to close a second side of the cavity that is opposite the first side.

21. The method of claim 18, wherein the wall member is a discrete component that is received into the housing member along the insertion axis, and wherein the method further comprises fixedly coupling the wall member to the housing member.

22. The initiator assembly of claim 3, wherein the initiator housing includes a plurality of seal members, each of the seal members being received in an associated one of the terminal apertures and being sealingly engaged to the wall member and a corresponding one of the initiator terminals.

* * * * *